US007811736B2

(12) United States Patent
Aoki

(10) Patent No.: US 7,811,736 B2
(45) Date of Patent: Oct. 12, 2010

(54) IMAGE FIXING METHOD

(75) Inventor: Takayoshi Aoki, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1333 days.

(21) Appl. No.: 11/073,748

(22) Filed: Mar. 8, 2005

(65) Prior Publication Data

US 2006/0051694 A1 Mar. 9, 2006

(30) Foreign Application Priority Data

Sep. 3, 2004 (JP) ..... 2004-256832

(51) Int. Cl.
*G03G 15/20* (2006.01)

(52) U.S. Cl. ..... 430/111.4; 430/124.1; 399/328

(58) Field of Classification Search ..... 430/124.1, 430/111.4; 399/328
See application file for complete search history.

(56) References Cited

U.S. PATENT DOCUMENTS

| | | | | |
|---|---|---|---|---|
| 5,262,265 | A * | 11/1993 | Matsunaga et al. | 430/109.2 |
| 5,558,967 | A * | 9/1996 | Nagatsuka et al. | 430/108.6 |
| 2001/0046636 | A1* | 11/2001 | Daimon et al. | 430/109.4 |
| 2002/0061457 | A1* | 5/2002 | Okuno et al. | 430/108.6 |
| 2003/0108808 | A1* | 6/2003 | Inoue et al. | 430/108.8 |
| 2003/0232266 | A1* | 12/2003 | Sugiura et al. | 430/107.1 |
| 2004/0001732 | A1* | 1/2004 | Kikuchi | 399/328 |
| 2004/0043319 | A1* | 3/2004 | Horiuchi et al. | 430/110.1 |
| 2004/0132920 | A1* | 7/2004 | Matsumura et al. | 525/418 |
| 2005/0208404 | A1* | 9/2005 | Miyakawa et al. | 430/108.1 |
| 2005/0208414 | A1* | 9/2005 | Nakamura et al. | 430/110.2 |
| 2005/0214669 | A1* | 9/2005 | Hayashi et al. | 430/109.4 |

FOREIGN PATENT DOCUMENTS

| | | | |
|---|---|---|---|
| JP | 58-178385 | A | 10/1983 |
| JP | 59-33785 | A | 2/1984 |
| JP | 59-33788 | A | 2/1984 |
| JP | 2003-149864 | A | 5/2003 |
| JP | 2005-24933 | A | 1/2005 |

* cited by examiner

*Primary Examiner*—Mark F Huff
*Assistant Examiner*—Rachel L Burney
(74) *Attorney, Agent, or Firm*—Oliff & Berridge, PLC

(57) ABSTRACT

An image-fixing method for heat-fixing a toner image, by feeding an transfer medium carrying the toner image between a heating unit heated by an induction-heating process and a pressurizing unit placed to press against the heating unit, wherein the electric resistivity at least of the outermost layer of the heating unit is $10^{-7}$ Ωm or more and less than $10^{-2}$ Ωm, and the toner image is formed by using a toner containing an amorphous resin having an ionic concentration in the range of $10^{-5}$ to $10^{-3}$ mole/g as the binder resin.

12 Claims, No Drawings

IMAGE FIXING METHOD

CROSS-REFERENCE TO RELATED APPLICATION

This application claims priority under 35 USC 119 from Japanese Patent Application No. 2004-256832, the disclosure of which is incorporated by reference herein.

BACKGROUND OF THE INVENTION

1. Field of the Invention

The present invention relates to an image-fixing method, and in particular to an image-fixing method suitable for use in machines making use of electrophotographic processes such as copying machines, printers, and facsimiles.

2. Description of the Related Art

Permanent images are formed in an electrophotographic process, during copying, by forming an electrostatic latent image on a photoreceptor made of a photoconductive material, developing the latent image with a toner into a toner image using, for example, a magnetic brush method, transferring the toner image on the photoreceptor onto a recording medium (transfer medium) such as paper or a sheet, and then fixing the image using heat, solvent, or pressure.

Heat melting processes have been most widely used for fixing transferred toner images and are classified largely into two processes: contact processes and non-contact processes. In particular, contact heat-roll fixing processes, which are superior in thermal efficiency and thus allow high-speed fixing, have been widely employed recently in commercial copying machines, printers, etc. However, heat-roll fixing processes have some drawbacks. It has been pointed out that one of the most serious drawbacks is that they require a longer standby time (warming-up time) before use.

Heat-fixing processes are of course far superior to pressure-fixing processes, which are ready to operate immediately after power has been turned on, in durability of fixed images formed on a recording medium such as paper and in resistance to deformation, cockle generation, etc. of the paper due to pressure. Accordingly, methods for shortening the standby time of heat-roll fixing processes have been intensively studied.

One of the promising approaches for achieving the object above is to use a toner binder resin that, for example, has a glass transition temperature (Tg) of several tens of degrees lower than, or has a molecular weight lower than, that of commonly used resins. However, many such toners have a fatal drawback in that they often aggregate or exhibit a caking phenomenon during storage or in a copying machine.

To solve the problem above, a method was proposed of adhering very fine particles such as colloidal silica, alumina, or titania to the surface of toner particles for improvement in blocking resistance and flowability. The method does not demand a significant increase of the lowest fixing temperature and improves the blocking resistance and flowability of the toner to some extent. However, the fine particles, even if subjected to heat treatment or the like for adhesion to the toner particle surface, are often released from the toner particle surface, negatively affecting the photoreceptor, in particular one having a surface coated with an organic polymer or the like. In other words, the method leads to the disadvantage that the fine particles are adhered semipermanently to the photoreceptor surface during repeated use, causing the trouble of image defects. Therefore, the method is not an ultimate solution.

In addition, use of the binder resin described above in the heat-roll fixing process leads to the problem of occurrence of an offset phenomenon, wherein toner particles are adhered to a heating roll and the adhered toner particles stain the next copy, because of the resin's inherent thermal properties. In particular, increasing the amount of heat applied per unit time to cope with increased fixing speed during high-speed copying results in a higher incidence of the offset phenomenon.

Use of various waxes in large amount as the fixing aid for the toner has also been proposed. However, these methods also carry the drawbacks of the toner particle-caking phenomenon described above and other secondary problems.

In a heat-roll fixing process, curling of a transfer medium, generally paper, around a fixing roll after fixing is ordinarily prevented by a stripper finger placed in the fixing roll unit (heating unit). However, with the recent trend toward higher-speed copying machines, stress applied to this site has become larger, leading to more frequent trouble including inadequate release and image defects at the edge of the transfer medium caused by the finger tip during release.

Exfoliation or local detachment of the surface layer of fixing units due to inadequate release and excessive application of local stress further causes fatal defects in the surface of the fixing units (heating unit and pressurizing unit) surface. For example, the surface layer of the heating unit is usually coated with a layer of polymer superior in release properties such as a silicone or fluorocarbon resin for prevention of toner particle adhesion, and if the layer is damaged, toner components remain on the surface of the heating unit. This causes the offset phenomenon wherein toner is retransferred onto an unintended printing face.

On the other hand, induction-heating processes have been proposed as fixing methods for shortening the standby time before use (for example, Japanese Patent Application Laid-Open (JP-A) Nos. 58-178385, 59-33785, and 59-33788). Some of the processes are now being practically applied, but the processes still required coating of the metal roll heated by induction with, for example, a silicone or fluorocarbon resin for ensuring toner-releasing properties. Also, defects in the fixed coat layer, generated during repeated use by unintended paper jamming or the like, could not be prevented, resulting in a drastic decrease in reliability.

The present invention is made in view of these circumstances in the related art to overcome the problems. Thus, the invention is devised to provide an image-fixing method applicable to more resource- and energy-saving fixing systems that shortens standby time without an increase in power consumption and that eliminates degradation of a fixing unit surface even with long-term repeated use or after paper jamming.

SUMMARY OF THE INVENTION

A first aspect of the present invention provides an image-fixing method for heat-fixing a toner image, by feeding a transfer medium carrying the toner image between a heating unit heated by an induction-heating process and a pressurizing unit placed to press against the heating unit, wherein the electric resistivity of the outermost layer of the heating unit is $10^{-7}$ Ωm or more and less than $10^{-2}$ Ωm, and the toner image is formed by using a toner containing an amorphous resin having an ionic concentration in the range of $10^{-5}$ to $10^{-3}$ mole/g as the binder resin.

A second aspect of the invention second provides an image-fixing method for heat-fixing a toner image, by feeding a transfer medium carrying the toner image between a heating unit heated by an induction-heating process and a pressurizing unit placed to press against the heating unit, wherein the electric resistivity at least of the outermost layer of the heating unit is $10^{-7}$ Ωm or more and less than $10^{-2}$ Ωm, and the toner image is formed with a toner containing a crystalline resin having a cross-linked structure and a melting point in the range of 40 to 80° C.

Further, a third aspect of the invention provides an image-fixing method for heat-fixing a toner image, by feeding a transfer medium carrying the toner image between a heating unit heated by an induction-heating process and a pressurizing unit placed to press against the heating unit, wherein the electric resistivity of the outermost layer of the heating unit is $10^{-7}$ Ωm or more and less than $10^{-2}$ Ωm, and the toner image is formed with a toner containing an amorphous resin having a melt flow viscosity as determined by a melt flow tester in the range of $10^5$ to $10^8$ Pa·s at 110° C. under a load 0.98 MPa and a number-average molecular weight in the range of 2,000 to 10,000.

DETAILED DESCRIPTION OF THE INVENTION

As described above, an induction-heating process is an excellent method for shortening the standby time (warm-up time) before use. It is effective to place a material having an electric resistivity of less than $10^{-2}$ Ωm at the outermost layer of heating unit for making the most of the advantageous effects of the process. However, common metal elements or the alloys thereof, materials having an electric resistivity of less than $10^{-2}$ Ωm, cause the offset phenomenon that the toner is adhered locally onto the heating unit, because the release properties of the metal materials are inferior to those of common surface layer materials for fixing rolls such as silicone and fluorocarbon resins.

On the other hand, coating of the metal roll, for example, with a fluorocarbon resin for prevention of the offset phenomenon may eliminate the problem of offsetting, but also leads to deterioration in durability due to breakdown of the coated layer and elongation of the warming-up time.

Accordingly, for making the most of the merits of the induction-heating process sufficiently, it is essentially necessary to use a toner favorable in release properties even when a heating unit having a metal as the outermost layer is used.

After intensive studies, the inventors have found that it was possible to provide a toner having stabilized release properties for use in a heating unit such as a fixing roll having a material having an electric resistivity of less than $10^{-2}$ Ωm at least in the outermost layer by using an amorphous or crystalline resin having a particular structure and particular properties as the binder resin for toner and thus providing the toner with a better melting viscoelasticity and better release properties, as will be described below.

Thus, it allows rapid and direct application of heat to the toner particles and image formation in the minimum standby time, which are the advantages of induction-heating process, by using the fixing unit in the configuration above and the toner of which the properties are adjusted in particular ranges in the image-fixing method by induction-heating process. In addition, materials having an electric resistivity of less than $10^{-2}$ Ωm generally represent metal elements or the alloys thereof having a surface hardness and a surface abrasion resistance far higher than those of common fixing-roll surface-layer materials such as silicone and fluorocarbon resins, and thus provide a fixing device having a favorable long-term durability and a favorable durability against abnormal stresses, for example, by paper jamming.

Hereinafter, the first to third image-fixing methods according to the present invention will be described separately.

<First Image-fixing Method>

The fixing device by induction-heating process for use in the invention is first described below.

In the fixing device by induction-heating process, for example, an open-magnetic-circuit iron core wound concentrically with a coil is placed inside a heat-fixing roll (heating unit) of a conductive metal, a high-frequency electric current is applied to the coil close to the internal surface of the heat-fixing roll, an induction eddy current is generated in the fixing roll by the high-frequency magnetic field thus generated, and the fixing roll is heated by the Joule heat generated by the surface resistance of the fixing roll.

The surface temperature of the heated heat-fixing roll is monitored by a temperature-sensing device installed in the heat-fixing roll and is controlled to a constant temperature by the control means. The temperature-sensing device is not particularly limited, and for example, a thermistor and temperature sensor may be used.

The heating unit for use in the invention should has an electric resistivity at least of the outermost layer of $10^{-7}$ Ωm or more and less than $10^{-2}$ Ωm. The phrase "at least of the outermost layer" means that all materials used in the entire heating unit may have an electric resistivity satisfying the above range or only the outermost layer formed in the heating unit may have an electric resistivity in the range.

The electric resistivity is preferably in the range of $10^{-6}$ to $10^{-3}$ Ωm. It is practically impossible to make the electric resistivity lower than $10^{-7}$ Ωm, and a heating unit having an electric resistivity of $10^{-2}$ Ωm or more may result in insufficient generation of the Joule heat by the induction-heating process, prohibiting reduction of the warming-up time.

Almost all common metals and various alloys may be used as the material having an electric resistivity of less than $10^{-2}$ Ωm. Examples of the materials favorably used include common metals such as aluminum, chromium, copper, iron, magnesium, nickel, titanium, and zinc; alloys of the metals above containing nonmetals such as silicon, carbon, phosphorus, sulfur, oxygen, and chlorine; alloys containing one or more of the metals above as well as one or more metals selected from molybdenum, tungsten, vanadium, cobalt, beryllium, bismuth, lead, tin, lithium, sodium, calcium, gallium, arsenic, strontium, zirconium, cadmium, indium, tellurium, barium, tantalum, gold, and silver.

Among these metals, use of a metal of iron, copper, or aluminum or an alloy containing any one of these metals as the principal component is preferable, and use of iron is particularly preferable from the points of price and strength.

Needless to say, the outermost layer preferably has an electric resistivity in the favorable range described above from the viewpoint of the efficiency in induction heating; and although use of a magnetic material wherein the electric current flows mostly through the surface layer is more efficient in most cases, it is known that it is possible to use a low-resistivity metal such as aluminum, copper for heating by controlling the frequency of the current applied to the coil generating the induction current.

All kinds of induction-heating coils commonly used may be used as the coil used in the invention for generating the induction current for induction heating, and the induction-heating coil may be placed either inside or outside the fixing roll. If it is installed outside the fixing roll, a demagnetizing cover is commonly used together for prevention of heating of neighboring metal members.

The frequency of the high-frequency electric current applied to the coil is usually in the range of 1 to 100 kHz and preferably in the range of 10 to 80 kHz. Electric current with a frequency of less than 1 kHz may be insufficient for heating, while electric current with an frequency of more than 100 kHz may lead to an excessive energy loss in the heating coil.

The heating unit used in the invention is normally a roll in the cylindrical shape, but a heating unit in the belt shape that deforms according to the support may also be used. Roll-shaped heating units are cheaper and lower in fixing pressure, but belt-shaped heating units allow relatively free fixing device design and are superior in paper releasing and other properties.

Although the heating unit in fixing unit is described above, the pressurizing unit may have the same configuration as that described for the heating unit in the invention.

The toner for forming a toner image for use in the first image-fixing method will be described below. The toner for use in the invention contains an amorphous resin having an ionic concentration in the range of $10^{-5}$ to $10^{-3}$ mole/g as the binder resin in the toner. By adjusting the ionic concentration of the binder resin contained in the toner in the range above, it becomes possible to increase the melt elasticity of the toner at the fixing temperature and to ensure favorable release properties of the toner from the heating unit in the configuration above and favorable fixing property, The ionic concentration is preferably in the range of $1.5\times10^{-5}$ to $8\times10^{-4}$ mole/g. An ionic concentration of more than $10^{-3}$ mole/g results in a drastic increase in the lowest fixing temperature (the lowest temperature in the fixing temperature region exhibiting sufficient fixing and offsetting properties) and demand for an additional electric energy for fixing. Alternatively, an ionic concentration of less than $10^{-5}$ mole/g results in breakdown of agglomerated toner particles due to decrease in the aggregation force inside toner during heat-melting and thus adhesion of part of the toner components onto the fixing roll surface.

The ionic concentration means the concentration of an ion pair of anion and cation, and in the invention, the ionic concentration can be obtained by determining the amount of acrylic acid residues in the binder resin by FT-IR by with reference to a calibration curve previously obtained.

Specifically, a calibration curve is first prepared by measuring several resins having a known acrylic acid structure and different ionic concentrations according to a known method by FT-IR spectroscopy and determining the intensities of a particular peak (3,610 to 3,640 $cm^{-1}$) of the acrylic acid structure. The ionic concentration of an unknown binder resin is then determined based on the calibration curve, by conducting the same FT-IR measurement.

The amorphous resin for use as the binder resin for the toner used in the invention may be any one of addition polymerization resins, polycondensation resins, and other resins. The term "amorphous" in amorphous resin means that the resin shows only a stepwise change and does not show a distinct endothermic peak in a differential scanning calorimetry (DSC) measurement.

Examples of the addition polymerization resins include homopolymers or copolymers of styrenes such as styrene and chlorostyrene; monoolefins such as ethylene, propylene, butylene, and isobutylene; vinyl esters such as vinyl acetate, vinyl propionate, vinyl benzoate, and vinyl butyrate; α-methylene fatty monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinylmethylether, vinylethylether, and vinylbutylether; vinyl ketones such as vinylmethylketone, vinylhexylketone, and vinylisopropenylketone. And in addition, typical examples of the binder resins include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene, and polypropylene.

Monomers forming an ionic group in copolymerization with these addition polymerization monomers are unsaturated carboxylic acids, and typical examples thereof include acrylic acid, methacrylic acid, crotonic acid, isocrotonic acid, maleic acid, fumaric acid, itaconic acid, vinylacetic acid, citraconic acid, and mesaconic acid.

Favorable examples of the polycondensation resins obtained by the polycondensation above include polyester resins, polyurethane resins, epoxy resins, silicone resins, polyamides; and polyester resins are particularly favorable as the binder resin for toner; and these polyester resins are prepared in a reaction of a polyvalent hydroxy compound with a polyvalent carboxylic acid or the reactive acid derivative thereof such as lower alkyl ester, acid anhydride, and acid halide.

Examples of the polyvalent hydroxy compounds include glycols such as ethylene glycol, propylene glycol, 1,4-butanediol, 2,3butanediol, 1,5-pentanediol, 1,6-hexanediol, neopentylene glycol, 1,4-cyclohexane dimethanol, dipropylene glycol, and tripropylene glycol; bivalent hydroxy compounds such as bisphenol A and the derivatives thereof, the alkylene oxide adducts thereof, and hydrogenated bisphenols A; trivalent or higher hydroxy compounds such as glycerol, sorbitol, 1,4-sorbitan, and trimethylolpropane.

Examples of the polyvalent carboxylic acids include malonic acid, succinic acid, 1,2,5-hexanetricarboxylic acid, 1,2,7,8-octanetetracarboxylic acid, n-octyl-succinic acid, 1,3-dicarboxy-2-methyl-2-carboxymethylpropane, tetra (carboxydimethyl)methane, maleic acid, fumaric acid, dodecenylsuccinic acid, 1,2,4-cyclohexanetricarboxylic acid, phthalic acid, isophthalic acid, terephthalic acid, trimellitic acid, pyromellitic acid, and 1,2,4-naphthalenetricarboxylic acid.

Crystalline polyesters obtained by polycondensation of these compounds are not included. In addition, unreacted carboxyl groups and others on the polyester remaining after the polycondensation contribute to the ion pair formation described below.

Substances forming an ion pair with the resin containing carboxylic acid groups and others are most preferably metals (metals, metal-containing compounds, etc.), and in particular, bivalent or higher-valent metals or the compounds containing the same are preferable. Monovalent metals such as sodium, lithium, and potassium are more hydrophilic and thus may raise the environmental dependency of the resulting toner and developer. Further, nonmetallic cations may affect the electrostatic properties of toner and may reduce the thermal stability at high temperature, for example, during melt blending or during heating.

Examples of the metals include aluminum, barium, calcium, cobalt, chromium, copper, iron, magnesium, manganese, nickel, tin, strontium, zinc that ionize into a bivalent or higher-valent ion. Some of the metals react with a carboxylic acid as they are, but the reactivity of the metals are generally, preferably activated as hydroxide, oxide, halide, carbonate, carboxylate, or alkoxide.

Ion pairs between an amorphous resin and the metal may be formed (ionically cross-linked) after polymerization of the resin by adding the metal to the reaction solution, or alternatively, by adding the metal to a solution of the resin, which is previously purified and isolated.

There are some charge control agents having a metal-containing compound containing a metal such as chromium, nickel, zinc, aluminum, or iron; the metal in the charge control agent and the carboxylic acid group in the binder resin may react with each other during melt blending process; and it is possible to use such a reactive material in the blending process, if care is given to the electrostatic properties and the ionic concentration of the binding resin.

The glass transition temperature Tg of the binder resin for use in the invention is preferably in the range of 50 to 70° C. and more preferably in the range of 55 to 65° C. In addition, the number-average molecular weight of the binder resin is preferably in the range of 2,000 to 50,000 and more preferably in the range of 5,000 to 20,000.

The toner according to the invention contains a coloring agent as one of the primary constituent components, and typical examples of the coloring agents include dyes and pigments such as carbon black, nigrosin dye, aniline blue, Calco Oil Blue, chromium yellow, ultramarine blue, Du Pont oil red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 12, C.I. Pigment Blue 15:1, C.I. Pigment Blue 15:3; as well as magnetic materials such as magnetite and ferrite; and the like. The coloring agent may be added to the toner in an amount in the range of 2 to 50 mass %, and the coloring agent is not limited to the examples above at all.

It is also effective to add a known release-assisting material (releasing agent) for improvement in release properties from the heating unit, and usable release-assisting materials include, for example, polyethylene waxes, polypropylene waxes, paraffin waxes, ester waxes such as carnauba and montan waxes, and polyamide-based waxes.

The release-assisting materials usually added to common toners is in an amount in the range of approximately 0.5 to 7 mass %, but preferably added to the toner according to the invention in an amount slightly greater than that for common toners, i.e., in the range of approximately 5 to 30 mass % for a favorable result, because the heating unit such as a fixing roll does not have a coated releasing layer, for example, of a fluoropolymer on the surface. However, the addition amount is only a rough indication of the range and should be determined cautiously considering many factors including the material and the surface properties of the heating unit, the viscoelasticity of the binder resin, and the temperature controllability of the fixing system.

Because these releasing agents are present in a trace amount on the heating unit surface during continuous operation, the releasing capacity is retained even during operation after an off period in many cases, but before start up of a machine, such a releasing agent or a releasing oil may be previously coated in a trace amount. Alternatively, the release properties between the heating unit and the paper stripper finger may be adjusted to a suitable level, by supporting an oil-impregnated material such as web or a porous material consistently or intermittently into contact with the area as needed.

Process for producing the toner for use in the invention is generally a melt-blending pulverization method commonly practiced, but may be a so-called chemical production process such as a suspension polymerization, emulsion polymerization, dispersed-fine-particle coagulation method, phase inversion emulsification method, or microcapsulation method, and in such a case, the ion pairs may be formed in the particle-forming process.

The storage viscoelasticity G' of the toner according to the invention is preferably in the range of $5\times10^2$ to $1\times10^5$ Pa at 180° C. and more preferably in the range of $5\times10^2$ to $5\times10^4$ Pa. A storage viscoelasticity of less than $5\times10^2$ Pa may lead to adhesion of melted toner during fixing and a higher incidence of offsetting. Alternatively, a viscoelasticity of more than $1\times10^5$ Pa may lead to drastic deterioration in fixing property. The viscoelasticity was determined by using ARES measurement device manufactured by Rheometric Scientific. A toner formed in the tablet shape was placed on a parallel plate of 25 mm in diameter, and the storage viscoelasticity G' thereof is determined at 180° C. under the condition of an angular velocity ω of 10 rad/sec and a strain of 0.2%.

The volume average diameter D50 of the toner particles according to the invention, as determined by using Coulter Counter TAII (manufactured by Beckmann Coulter), is preferably in the range of 4.0 to 10.0 μm, more preferably in the range of 5.0 to 8.0 μm, and particularly preferably in the range of 5.0 to 7.0 μm. The toner having a volume average diameter of 4.0 μm or more can prevent generation of cloud due to scattering of the toner. Alternatively, the toner having an average of 10.0 μm or less can provide an image more favorable in quality.

In regard to the particle size distribution of the toner according to the invention, the ratio of cumulative 84% volume particle diameter (D84v) to cumulative 16% volume particle diameter (D16v), $(D84v/D16v)^{1/2}$ (GSDv: volume-average grain size distribution index), wherein the cumulative diameters are both determined from smaller particle diameter side in a Coulter Counter, is preferably 1.30 or less; and that based on number-average grain size $(D84p/D16p)^{1/2}$ (GSDP: number-average grain size distribution index) is 1.40 or less. An image favorable in quality can be obtained if GSDv is 1.30 or less and GSDp is 1.40 or less.

In addition, the toner according to the invention may further contain as needed known additives such as charge controlling agent, as well as other inorganic fine particles externally added including a flowability improver such as colloidal silica fine particles.

The toner according to the invention may be a two-component toner, a nonmagnetic mono-component toner, or a mono-component toner containing a magnetic material.

In the invention, however images may be formed freely on a recording medium without restrictions, are preferably formed in a common electrophotographic image-forming device by using the toner described above. Images are fixed in a fixing device by the induction-heating process, and when a fixing roll, for example, is used as the heating unit, the fixing temperature (surface temperature of fixing roll) is preferably in the range of 100 to 250° C.; the nip width between the heating and pressurizing units, in the range of 0.5 to 20 mm; and the paper (recording medium) traveling speed, in the range of 50 to 500 mm/sec.

<Second Image-fixing Method>

The second image-fixing method according to the invention will be described below. The image-fixing method and the conditions of the second image-fixing method is the same as those of the first image-fixing method except that the binder resin used for the toner is different. Accordingly, only the toner used will be described.

The toner used in the second image-fixing method has a crystalline resin having a cross-linking structure and a melting point in the range of 40 to 80° C. as the principal component of the binder resin. By using a crystalline resin having a low melting point and superior in release properties as the binder resin contained in the toner and raising the melt elasticity thereof by introducing a cross-linking structure into the crystalline resin, it is possible to ensure sufficiently high fixing and release properties from the heating unit.

A crystalline resin having a melting point in the range of 40 to 80° C. is used as the principal component of the binder resin according to the invention. The term "crystalline" in the crystalline resin means that the resin has a distinct endothermic peak and does not show a stepwise change in endothermic heat amount in differential scanning calorimetry (DSC) measurement.

The melting point of the crystalline resin is preferably in the range of 45 to 75° C. and more preferably in the range of 50 to 70° C.

The resin having a melting point of less than 40° C. may cause powder aggregation or decrease the storage life of the fixed image, while the resin of higher than 80° C. may not provide favorable release and fixing properties.

In the invention, the melting point of the crystalline resin above is a temperature at the maximum endothermic peak, as determined by using a differential scanning calorimeter (DSC) under the condition of a heating rate of 10° C. per minute in the temperature range from room temperature to 120° C.

The crystalline resins having a cross-linking structure and a melting point in the range of 40 to 80° C. for use in the toner according to the invention include crystalline resins prepared by polycondensation, and typical examples thereof include polyesters, polyurethanes, epoxy resins, silicone resins, polyamide resins. Polyesters are particularly favorable as the binder resin for toner, and such polyester resins are prepared from a polyvalent hydroxy compound and a polyvalent carboxylic acid or a reactive acid derivative thereof such as a lower alkyl ester, acid anhydride, or acid halide.

Examples of the polyvalent hydroxy compounds include glycols such as ethylene glycol, propylene glycol, 1,4-butanediol, 2,3-butanediol, 1,5-pentanediol, 1,6-hexanediol, neopentylene glycol, 1,4-cyclohexane dimethanol, dipropylene glycol, and tripropylene glycol; bivalent hydroxy compounds such as bisphenol A and the derivatives thereof, and the alkylene oxide adducts thereof, and hydrogenated bisphenol A; trivalent or higher-valent hydroxy compounds such as glycerol, sorbitol, 1,4-sorbitan, and trimethylolpropane.

Examples of the polyvalent carboxylic acids include malonic acid, succinic acid, 1,2,5-hexanetricarboxylic acid, 1,2,7,8-octanetetracarboxylic acid, n-octyl-succinic acid, 1,3-dicarboxy-2-methyl-2-carboxymethylpropane, tetra (carboxydimethyl)methane, maleic acid, fumaric acid, dodecenylsuccinic acid, 1,2,4-cyclohexanetricarboxylic acid, phthalic acid, isophthalic acid, terephthalic acid, trimellitic acid, pyromellitic acid, 1,2,4-naphthalenetricarboxylic acid.

Among the resins from these monomers, amorphous resins are not used in the second image-fixing method according to the invention. Resins prepared by copolymerization of a molecule having a side-chain, having many hetero atoms, or lacking symmetry are more amorphous generally, and thus, care should be given to the molecular structure of the polyvalent hydroxy compound and the polyvalent alcohol.

A cross-linking structure can be introduced into a crystalline resin by a method of introducing an unsaturated group into the polyvalent hydroxy compound or polyvalent alcohol and causing a cross-linking reaction, for example, with a peroxide; a method of cross-linking inonically terminal reactive acid groups such as carboxylic acid groups with a cation; a method of reacting a polyvalent metal compound with terminal hydroxyl groups; or the like. The method may also be physical cross-linking via hydrogen bonds, for example, in polyurethane and other resins.

In the invention, the crystalline resin having the above cross-linking structure preferably has the following viscoelastic properties:

When common logarithms of storage elasticities G's are plotted against temperature and the storage elasticity of the resin at the melting point Tm plus 20° C. is designated as G'(Tm+20) and at the melting point Tm plus 50° C., G'(Tm+50), the condition of the following equation (1) is preferably satisfied; and when common logarithms of loss modulus G"s are plotted against temperature and the loss modulus of the resin at the melting point Tm plus 20° C. is designated as G"(Tm+20), and that at the melting point Tm plus 50° C., G"(Tm+50), the condition of the following equation (2) is preferably satisfied, for prevention of offset generation.

$$|\log G'(Tm+20)-\log G'(Tm+50)|\leqq 1.5 \quad (1)$$

$$|\log G''(Tm+20)-\log G''(Tm+50)|\leqq 1.5 \quad (2)$$

These conditions mean that the viscosity of a crystalline resin having the cross-linking structure above is less dependent on temperature at a temperature higher than the melting point, the viscoelasticity curve, which decreases as the temperature rises and as the crystal fuses, has a point of inflection, and thus the viscoelasticity becomes even more independent of temperature.

The toner in the second image-fixing method can be prepared in a similar manner to the toner described in the first image-fixing method except that the binder resin is different. In addition, the toner in the second image-fixing method preferably has a storage elasticity at 180° C. in the same range as that of the first fixing method.

Further, preferable ranges of the toner particle size distribution, fixing condition, and others in the second image-fixing method are also the same as those of the first image-fixing method.

<Third Image-fixing Method>

The third image-fixing method according to the invention will be described below. The image-forming method, condition, and others of the third image-fixing method are the same as those of the first image-fixing method, except that the binder resin used for toner and the viscosity properties of the toner are different. Therefore, description about them is eliminated and only the toner used will be described.

The toner used in the third image-fixing method is preferably an amorphous resin having a viscosity in the range of $10^5$ to $10^8$ Pa·s as determined in a melt flow tester at a temperature of 110° C. under a load of 0.98 MPa (10 kgf/cm$^2$) and containing a binder resin having a number-average molecular weight in the range of 2,000 to 10,000. It becomes possible to improve both the release property and fixing property, by providing a toner with a certain viscosity or more and reducing the number-average molecular weight of the binder resin contained in the toner to a relatively low value.

Resins similar to the various amorphous resins described in the first image-fixing method may be used as the binder resin for the toner in the third image-fixing method. However, the number-average molecular weight thereof should be in the range of 2,000 to 10,000 for obtaining a favorable fixing property.

The number-average molecular weight is preferably in the range of 3,000 to 9,000 and more preferably in the range of 4,000 to 9,000. Binder resins having a number-average molecular weight of less than 2,000 are lower in adhesion power, making the fixed image brittler. If the number-average molecular weight is over 10,000, the lowest fixing temperature increases drastically, demanding additional electric energy for fixing.

The number-average molecular weight and the molecular weight distribution described below are determined by gel-permeation chromatography (GPC). The GPC systems used are HLC-8120GPC and SC-8020 (manufactured by Toso Corporation); two columns, TSKgel and SuperHM-H (manufactured by Toso Corporation, 6.0 mmID×15 cm), are used; and eluant is tetrahydrofuran (THF). Test conditions are as follows: sample concentration, 0.5 wt %; flow rate, 0.6 ml/min; sample injection, 10 μl; measurement temperature, 40° C.; and detector, an IR detector. A calibration curve is prepared by using ten "polystyrene standard samples TSK standard": A-500, F-1, F-10, F-80, F-380, A-2500, F4, F-40, F-128, and F-700" manufactured by Toso Corporation. In addition, the data collection interval during sample analysis is set to 300 ms.

Further, the toner used in the third image-fixing method should have a viscosity at 110° C. under a load of 0.98 MPa (10 kgf/cm$^2$) as determined by a melt flow tester (manufactured by Shimadzu Corporation) in the range of $10^5$ to $10^8$ Pa·s, for ensuring the release properties from heating unit.

The viscosity is preferably in the range of $2\times10^5$ to $5\times10^7$ Pa·s and more preferably in the range of $4\times10^5$ to $4\times10^7$ Pa·s. A toner having a viscosity of less than $10^5$ Pa·s leads to breakdown of agglomerated toner particles due to decrease in the aggregation force inside the toner during heat-melting, making part of the toner components more easily adhered onto the heating unit surface. On the contrary, a toner having a viscosity of over $10^8$ Pa·s does not provide a sufficient fixing property because of its excessively high viscosity.

In the invention, the molecular weight distribution, i.e., the ratio (Mw/Mn) of the weight-average molecular weight Mw to the number-average molecular weight Mn of the binder resin, is widened for attaining a relatively high melt viscosity with a relatively low-molecular weight resin.

In the invention, the ratio Mw/Mn of the binder resin is preferably in the range of 2 to 100 and more preferably in the range of 3 to 50. A binder resin having an Mw/Mn of less than 2 may not allow effective entanglement of the polymer chains, occasionally making it difficult to keep the viscosity not less than $10^5$ Pa·s. A binder resin having an Mw/Mn of over 100 may be too viscous, often resulting in an insufficient fixing property.

If an amorphous resin prepared by polymerization of, for example, an addition-polymerizable monomer is used as the amorphous resin for use as binder resin, the Mw/Mn thereof can be adjusted into the favorable range by copolymerization with a cross-linking agent and further mixing with a higher-molecular weight resin.

The toner in the third image-fixing method can be prepared basically in a similar manner to the toner described in the first image-fixing method except that the binder resin is different. In addition, preferable ranges of the particle size distribution, fixing condition, and others of the toner of the third image-fixing method are the same as those of the first image-fixing method.

EXAMPLE

Hereinafter, the invention will be described more specifically with reference to EXAMPLEs and COMPARATIVE EXAMPLEs, but it should be understood that the invention is not restricted by these EXAMPLEs at all. In the following description, "part" means "part by mass" and "%","mass %".

<Preparation of Toners>

(Toner 1)

To a solution of 100 parts of a styrene-acrylic resin containing styrene, n-butyl acrylate, and acrylic acid at a molar ratio of 76/15/9 (number-average molecular weight: 7,000, Tg: 67° C.) in 300 parts of xylene heated to 70° C., a solution of one part of magnesium ethoxide in 50 parts of ethanol is added dropwise, and the mixture is heated to 100° C. or more, and the solvent is removed by distillation under reduced pressure, to give an amorphous resin (1).

The ionic concentration of 1 g of the resin, as determined by calibration-curve analysis using an FT-IR, is approximately $2.9\times10^{-4}$ mole/g, and the storage elasticity G' at 180° C. is $2\times10^5$ Pa.

Amorphous resin (1) 100 parts

Carbon black (trade name: BP 1300, manufactured by Cabot) 6 parts

Polypropylene wax (trade name: P200, manufactured by Mitsui Chemicals, Inc., melting point: 145° C.) 7 parts Polyethylene wax (trade name: PE130, manufactured by Clariant, melting point: 125° C.) 5 parts The components above are melt-blended in a Banbury mixer, and the resulting mixture is cooled, pulverized in a jet mill, and classified, to give toner particles having a volume-average diameter of 8 μm and a GSDv and a GSDp respectively of 1.23 and 1.40. Silica fine particles having a volume-average particle diameter of 0.01 μm are added to the toner particles in an amount of 1%, and the mixture is blended in a Henschel Mixer, to give a toner 1.

(Toner 2)

5 parts of dodecanethiol and 3 parts of carbon tetrabromide are added to monomer components consisting of 400 parts of styrene, 90 parts of n-butyl acrylate, and 3 parts of acrylic acid, to give a liquid monomer mixture. Thirty parts of the liquid mixture is poured into 700 parts of ion-exchange water and dispersed well, and after addition of an aqueous ammonium persulfide solution, the mixture is heated to a liquid temperature of 72° C. The remaining 463 parts of the liquid monomer mixture is then added dropwise to the mixture above over 5 hours, to give a dispersion of the styrene-acrylic acid copolymer resin.

The number-average molecular weight of the copolymer resin is 5,500 and the Tg is 62° C.

To a mixture of 100 parts of the dispersion above, 18 parts of a colorant dispersion containing 20% carbon black dispersed with a surfactant, and 50 parts of a releasing agent dispersion containing 15% paraffin wax dispersed with a surfactant, added is 4 parts of an aqueous 20% calcium chloride solution, and the mixture is dispersed in a homogenizer and then left at 50° C. for 2 hour, to give a dispersion wherein the particles in respective dispersions above are coagulated. 5 parts of an anionic surfactant is then added to the dispersion; the mixture is heated to 96° C. while agitated for complete fusion of the coagulated particles and then allowed to cool down to room temperature. The resulting particles are then filtered, washed with water, and freeze/dried, to give toner particles having a volume average diameter of 6.5 μm and a GSDv and a GSDp respectively of 1.23 and 1.24.

The ionic concentration of 1 g of the resin, as determined by calibration-curve analysis using an FT-IR, is approximately $2\times10^{-4}$ mole/g. Silica fine particles having a volume-average particle diameter of 0.01 μm are added to the toner particles in an amount of 0.8%, and the mixture is agitated in a Henschel Mixer, to give a toner 2.

(Toner 3)

A toner 3 having a volume-average particle diameter of 8.4 μm and a GSDv and a GSDp respectively of 1.24 and 1.41 is prepared in a similar manner to the preparation of toner 1, except that the amount of magnesium ethoxide solution added dropwise in preparation of toner 1 is changed to 5 parts and an amorphous resin having an ionic concentration of approximately $1.25\times10^{-3}$ mole/g is used.

The number-average molecular weight of the amorphous resin is 7,200; the Tg 68° C.; and the storage elasticity G' at 180° C., $2\times10^{7}$ Pa.

(Toner 4)

A toner 4 having a volume-average particle diameter of 7.9 μm and a GSDv and a GSDp respectively of 1.23 and 1.39 is prepared in a similar manner to the preparation of toner 1, except that the amount of magnesium ethoxide solution added dropwise in preparation of toner 1 is changed to 0.03 part and an amorphous resin having an ionic concentration of approximately $8.7\times10^{-6}$ mole/g is used.

The number-average molecular weight of the amorphous resin is 7,000; the Tg, 65° C.; and the storage elasticity G' at 180° C., $7\times10^{4}$ Pa.

(Toner 5)

A mixture of 130 arts of adipic acid, 159 parts of 1,9-nonanediol, 25 parts of sodium 5-sulfoisophthalate, and 0.25 part of dibutyltin oxide is polymerized at 200° C. by dehydration polycondensation, to give a crystalline polyester.

The number-average molecular weight of this crystalline polyester is 15,000 and the melting point 62° C.

200 Parts of the crystalline polyester is poured into 1,500 parts of purified water, and the mixture is dispersed for a long period at 98° C. by using a high-shear agitator, to give a resin dispersion. To 1,000 parts of the resin dispersion, added are 150 parts of a coloring agent dispersion containing 20% carbon black (trade name: R330, manufactured by Cabot) dispersed with a surfactant and 400 parts of a releasing agent dispersion containing 15% polyolefin wax (trade name: Poly-Wax725, manufactured by Toyo-Petrolite) dispersed with a surfactant are added; then, 1.5 parts of magnesium sulfate, a coagulant and cross-linking agent, is added to the mixture while agitated in a homogenizer; and the resulting mixture is left at 50° C. for 2 hours, to give a dispersion wherein the particles in respective dispersions are coagulated. 5 parts of an anionic surfactant is added to the dispersion, and the mixture is heated to 96° C. while agitated for complete fusion of the coagulated particles and allowed to cool down to room temperature. The particles are then filtered, washed with water, and freeze-dried, to give toner particles having a volume average diameter of 6.0 μm and a GSDv and a GSDp respectively of 1.23 and 1.24.

The storage elasticity G' of the toner particles at 180° C. is $8\times10^{6}$ Pa. Silica fine particles having a volume-average particle diameter of 0.012 μm are added to the toner particles in an amount of 0.4%, and the mixture is agitated in a Henschel mixer, to give a toner 5.

(Toner 6)

A mixture of 180 parts of sebacic acid, 12 parts of fumaric acid, 91 parts of 1,4-butanediol, and 0.3 part of dibutyltin oxide is polymerized at 180° C. by dehydration polycondensation, to give a crystalline polyester.

The number-average molecular weight of the crystalline polyester is 9,000, the melting point 68° C.

To 85 parts of the crystalline polyester, 4 parts of copper phthalocyanine pigment and 200 parts of ethyl acetate are added, and the mixture is dispersed in a ball mill, to prepare a resin dispersion. Into a nitrogen-substituted flask containing 300 parts of an aqueous 1.2% carboxymethylcellulose solution, 15 parts of calcium carbonate is added; then 100 parts of the resin dispersion above is added; and the mixture is agitated under high-speed agitation, to give a resin suspension. To the suspension, 20 parts of a 10% 2,2'-azobisisobutylonitrile toluene solution and 30 parts of a 20% isoparaffin wax toluene dispersion are added, and the mixture is allowed to react at 80° C. for 1 hour, forming a cross-linking structure. An excess amount of water is poured to the solution, and then, calcium carbonate therein is dissolved with hydrochloric acid. The particles are then washed repeatedly with water, filtered, and dried, to give toner particles having a volume average diameter of 8.2 μm.

The storage elasticity G' of the toner particles at 180° C. is $5\times10^{5}$ Pa. Silica fine particles having a volume-average particle diameter of 0.012 μm are added to the toner particles in an amount of 0.4%, and the mixture is agitated in a Henschel Mixer, to give a toner 6.

(Toner 7)

A toner 7 having a volume-average particle diameter of 7.2 μm and a GSDv and a GSDp respectively of 1.25 and 1.33 is prepared in a similar manner to the preparation of toner 6, except that the 2,2-azobisisobutylonitrile toluene solution described in preparation of toner 6 is not used and the later heating is not carried out.

The storage elasticity G' of the toner particles at 180° C. is $1\times10^{3}$ Pa.

(Toner 8)

A mixture of 21 parts of bisphenol A bi-ethylene oxides adduct, 21 parts of bisphenol A bi-propylene oxides adduct, 7 parts of a succinic acid derivative, 4 parts of terephthalic acid, and 25 parts of trimellitic acid is polymerized at 210° C. by dehydration polycondensation, to give a cross-linked polyester resin having a number-average molecular weight Mn of 6,000 and a Mw/Mn ratio of 12.5.

Cross-linked polyester resin 100 parts

Carbon black (trade name: BP 1300, manufactured by Cabot) 10 parts

Polypropylene wax (trade name: P200, manufactured by Mitsui Chemicals, Inc., melting point: 145° C.) 7 parts Polyethylene wax (trade name: PE130, manufactured by Clariant, melting point: 125° C.) 7 parts The components above are melt-blended in a Banbury mixer, and the resulting mixture is cooled, pulverized in a jet mill, and classified, to give toner particles having a volume-average particle diameter of 10 μm and a GSDv and a GSDp respectively of 1.22 and 1.40. Silica fine particles having a volume-average particle diameter of 0.012 μm are blended to the toner particles in an amount of 0.3%, and the mixture is agitated in a Henschel Mixer, to give a toner 8.

The toner 8 is molded into pellets, and the viscosity of the pellet, as determined by a melt flow tester (trade name: CFT-500, manufactured by Shimadzu Corporation) under the condition of a temperature of 110° C. and a load of 0.98 MPa (10 kgf/cm$^2$), is $5\times10^{5}$ Pa·s.

(Toner 9)

A toner 9 having a volume-average particle diameter of 9 μm and a GSDv and a GSDp respectively of 1.25 and 1.44 is prepared in a similar manner to preparation of toner 8, except that a styrene-butyl acrylate copolymer (copolymerization monomer weight ratio: 77/23, number-average molecular weight Mn: 7,000, and Mw/Mn: 35.5) is used as the binder resin replacing the cross-linked polyester resin.

The toner 9 is molded into pellets, and the viscosity of the pellet, as determined by a melt flow tester (trade name: CFT-500, manufactured by Shimadzu Corporation) under the condition of a temperature of 110° C. and a load of 0.98 MPa (10 kgf/cm$^2$), is $7.5\times10^5$ Pa·s.

(Toner 10)

A toner 10 having a volume-average particle diameter of 8.8 μm, and a GSDv and a GSDp respectively of 1.21 and 1.41 is prepared in a similar manner to preparation of toner 8, except that a cross-linked polyester resin having a number-average molecular weight Mn of 11,000 and an Mw/Mn ratio of 28.2 is used as the binder resin.

The toner 10 is molded into pellets, and the viscosity of the pellet, as determined by a melt flow tester (trade name: CFT-500, manufactured by Shimadzu Corporation) under the condition of a temperature of 110° C. and a load of 0.98 MPa (10 kgf/cm$^2$), is $2\times10^8$ Pa·s.

(Toner 11)

A toner 11 having a volume-average particle diameter of 8.9 μm and a GSDv and a GSDp respectively of 1.20 and 1.40 is prepared in a similar manner to preparation of toner 9, except that a styrene-butyl acrylate resin having a number-average molecular weight Mn of 6,500 and an Mw/Mn ratio of 4.5 is used as the binder resin.

The toner 11 is molded into pellets, and the viscosity of the pellet, as determined by a melt flow tester (trade name: CFT-500, manufactured by Shimadzu Corporation) under the condition of a temperature of 110° C. and a load of 0.98 MPa (10 kgf/cm$^2$), is $0.8\times10^5$ Pa·s.

<Preparation of a Carrier and Developers>

A resin-coated carrier is obtained by coating a styrene-acrylic resin (weight-average molecular weight: 70,000) over the surface of a ferrite core having a volume-average particle diameter of 60 μm manufactured by PowderTech Corp. Developers for toners 1, 3, and 4 are prepared by mixing 5.5 parts of each toner and 94.5 parts of the resin-coated carrier, and developers for other toners by mixing 7 parts of each toner and 93 parts of the resin-coated carrier.

Examples 1 to 6 and Comparative Examples 1 to 2, 4, and 6 to 7

A fixing unit of PREMAGE355 manufactured by Toshiba TEC Corp. [a digital copying machine equipped with an induction-heating fixing device having an output of 35 sheets per minute and having a fluoroplastic layer (electric resistivity: $10^{16}$ Ωm) as the outermost layer] is removed, and a steel roll (containing trace amounts of carbon, silicon, chromium, and manganese) having the same outer diameter and an electric resistivity of $3\times10^{-3}$ Ωm is installed replacing the fixing roll (heating unit) of the unit, and additionally, wiring for supply power to the fixing unit is provided, to give a test fixing unit.

Separately, for the purpose of obtaining an unfixed toner image, the fixing unit of DC550 manufactured by Fuji Xerox Co., Ltd. is removed and the machine is so modified that the copied sheet can be discharged therefrom as unfixed. By filling each of the toners shown in EXAMPLEs and COMPARATIVE EXAMPLEs of Table 1 into the developer case of the copying machine, an unfixed toner image (painted image of 5 cm×5 cm in size) by each of the toners is transferred onto J paper manufactured by Fuji Xerox Co., Ltd.

Each of the unfixed toner images is fixed in the modified fixing unit, while the setting temperature of the fixing roll is gradually raised from 140° C. to 200° C. at an interval of 5° C., and the following items are evaluated.

(Fixing Property)

The fixing property is evaluated from the lowest fixing temperature of fixed image according to the following criteria. The image evaluated is a solid image having a toner load of 4.0 g/m$^2$, and the lowest fixing temperature is defined as a temperature at which the maximum width of a damaged image area due to exfoliation of toner when the toner image is bent becomes not more than 0.5 mm.

Favorable: Lowest fixing temperature of around 150° C.

Slightly unfavorable: Lowest fixing temperature of around 160° C.

Unfavorable: Lowest fixing temperature of around 170° C.

(Offsetting Property)

The offsetting property is evaluated by visual observation of the offset state of fixed image, according to the following criteria.

Favorable: Offset generation at the lowest fixing temperature plus 35° C. or more Unfavorable: Offset generation at a temperature of not more than the lowest fixing temperature plus 30° C.

(Fixing Roll Strength)

Considering operations for forceful removal of a jammed paper or OHP sheet, the fixing roll strength is evaluated by visual observation of the change in appearance of the surface after repeated abrasion with a wire brush according to the following criteria.

Favorable: No damage affecting image quality detectable.

Unfavorable: One or more scratches affecting image quality detectable

Comparative Examples 3, 5, and 8

By using the fixing unit of the PREMAGE355 as a fixing unit as it is, output unfixed toner images are evaluated under the same conditions as those in the EXAMPLEs above.

Results are summarized in Table 1.

TABLE 1

| | Toner | Fixing property | Offsetting property | Fixing roll strength |
|---|---|---|---|---|
| Example 1 | 1 | Favorable | Favorable | Favorable |
| Example 2 | 2 | Favorable | Favorable | Favorable |
| Comparative Example 1 | 3 | Slightly unfavorable | Favorable | Favorable |
| Comparative Example 2 | 4 | Favorable | Unfavorable | Favorable |
| Comparative Example 3 | 1 | Favorable | Favorable | Unfavorable |
| Example 3 | 5 | Favorable | Favorable | Favorable |
| Example 4 | 6 | Favorable | Favorable | Favorable |
| Comparative Example 4 | 7 | Favorable | Unfavorable | Favorable |
| Comparative Example 5 | 5 | Favorable | Favorable | Unfavorable |
| Example 5 | 8 | Favorable | Favorable | Favorable |
| Example 6 | 9 | Favorable | Favorable | Favorable |
| Comparative Example 6 | 10 | Slightly unfavorable | Favorable | Favorable |
| Comparative Example 7 | 11 | Favorable | Unfavorable | Favorable |
| Comparative Example 8 | 8 | Favorable | Favorable | Unfavorable |

The methods in EXAMPLEs 1 to 6 are more reliable because the toner described in the first to third image-fixing methods according to the invention is used, the heat generated in the induction-heating process is transferred smoothly to the toner layer, and the strength of the member surface is higher even when used in a fixing device by the induction-heating process using a fixing unit having an electric resistivity of less than $10^{-2}$ Ω; and further, the methods exhibit an performance superior in fixing and offsetting properties even without a releasing layer, which is smaller in strength.

In contrast, the method in COMPARATIVE EXAMPLE 1 is insufficient in fixing property because the ionic concentration of the toner binder exceeds $10^{-3}$ mole/g, and the method in COMPARATIVE EXAMPLE 2 is lower in offsetting property because the ionic concentration is less than $10^{-5}$ mole/g. In addition, the method in COMPARATIVE EXAMPLE 4 is inferior in offsetting property because the toner binder resin does not have a cross-linked structure. The method of COMPARATIVE EXAMPLE 6 is also inferior in fixing property because the number-average molecular weight of the toner binder is larger than 10,000; and the method of COMPARATIVE EXAMPLE 7 is inferior in offsetting property because the toner binder viscosity under a designated condition is not more than $10^5$ Pa·s.

However, the surface strength of fixing roll is unsatisfactory in COMPARATIVE EXAMPLEs 3, 5, and 8, but the steel fixing roll used in EXAMPLEs 1 to 6 having a fixing-roll surface with an electric resistivity of less than $10^{-2}$ Ωm is superior in strength, consequently leading to improvement in reliability.

What is claimed is:

1. An image-fixing method for heat-fixing a toner image, by feeding a transfer medium carrying the toner image between a heating unit heated by an induction-heating process and a pressurizing unit placed to press against the heating unit, wherein the electric resistivity at least of an outermost layer of the heating unit is $10^{-7}$ Ωm or more and less than $10^{-2}$ Ωm, and the toner image is formed with a toner containing a crystalline resin having a cross-linked structure and a melting point in a range of 40 to 80° C., wherein the crystalline resin contains a resin containing a cross-linked structure formed by ionic bonds.

2. The image-fixing method of claim 1, wherein the storage viscoelasticity G' of the toner at 180° C. is in the range of $5\times10^2$ to $1\times10^5$ Pa.

3. The image-fixing method of claim 1, wherein the outermost layer of the heating unit is made of iron, copper or aluminum, or an alloy having one of these metals as the principal component.

4. The image-fixing method of claim 1, wherein the frequency of a high-frequency electric current used in the induction-heating process is in the range of 1 to 100 kHz.

5. An image-fixing method for heat-fixing a toner image, by feeding a transfer medium carrying the toner image between a heating unit heated by an induction-heating process and a pressurizing unit placed to press against the heating unit, wherein the electric resistivity of an outermost layer of the heating unit is $10^{-7}$ Ωm or more and less than $10^{-2}$ Ωm, and the toner image is formed with a toner containing an amorphous resin having a melt flow viscosity as determined by a melt flow tester in a range of $10^5$ to $10^8$ Pa·s at 110° C. under a load 0.98 MPa and a number-average molecular weight in the range of 2,000 to 10,000.

6. The image-fixing method of claim 5, wherein the amorphous resin contains a resin prepared by polymerization of an addition polymerizable monomer.

7. The image-fixing method of claim 5, wherein the amorphous resin contains a polycondensation resin.

8. The image-fixing method of claim 5, wherein the storage viscoelasticity G' of the toner at 180° C. is in the range of $5\times10^2$ to $1\times10^5$ Pa.

9. The image-fixing method of claim 5, wherein the outermost layer of the heating unit is made of iron, copper or aluminum, or an alloy having one of these metals as the principal component.

10. The image-fixing method of claim 5, wherein the frequency of a high-frequency electric current used in the induction-heating process is in the range of 1 to 100 kHz.

11. The image-fixing method of claim 1, wherein the crystalline resin is selected from the group consisting of polyesters, polyurethanes, epoxy resins, silicone resins, and polyamide resins.

12. The image-fixing method of claim 5, wherein the amorphous resin is selected from the group consisting of polyesters, styrene-alkyl acrylate copolymers, and styrene-alkyl methacrylate copolymers.

* * * * *